United States Patent [19]

Schäfer

[11] 4,417,541

[45] Nov. 29, 1983

[54] APPARATUS FOR SPRAYING WORKPIECES AND INTERCEPTING OVERSPRAY

[75] Inventor: Gerhard Schäfer, Nunkirchen-Salchendorf, Fed. Rep. of Germany

[73] Assignee: Fritz Schäfer Gesellschaft mit beschränkter Haftung, Neunkirchen-Salchendorf, Fed. Rep. of Germany

[21] Appl. No.: 380,952

[22] Filed: May 21, 1982

[30] Foreign Application Priority Data

May 23, 1981 [DE] Fed. Rep. of Germany ... 8115387[U]

[51] Int. Cl.[3] ..... B05B 13/00; B05B 15/04

[52] U.S. Cl. ..... 118/326; 118/326; 118/DIG. 7; 427/421; 98/115 SB

[58] Field of Search ..... 427/421; 118/326, 323, 118/DIG. 7; 98/115 SB

[56] References Cited

U.S. PATENT DOCUMENTS 4,279,215 7/1981 Schafer ..... 118/326

*Primary Examiner*—Shrive P. Beck

*Attorney, Agent, or Firm*—Karl F. Ross

[57] ABSTRACT

A spray booth provided with a horizontally oriented nozzle for the surface-coating (e.g. coloring) of suspended workpieces passing by on a transporter is provided with an upright stationary screen intercepting excess coating material. The screen is spaced from the floor of the booth so as to enable the continuous circulation of two wipers therearound, one of them ascending behind the screen while the other descends on its front surface facing the nozzle. The screen is overlain by a sprinkler depositing solvent on its front surface to keep the intercepted coating material in a liquid state.

7 Claims, 4 Drawing Figures

FIG. 2
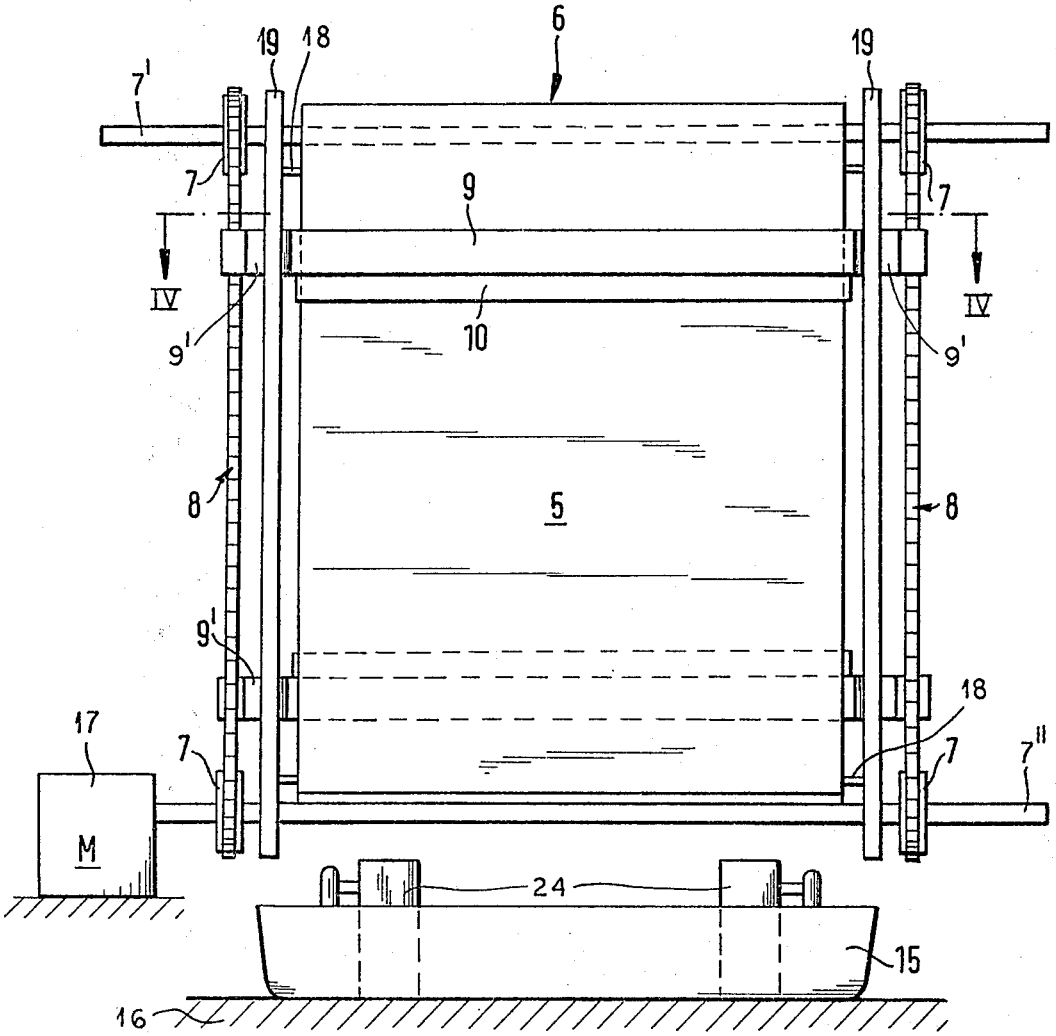
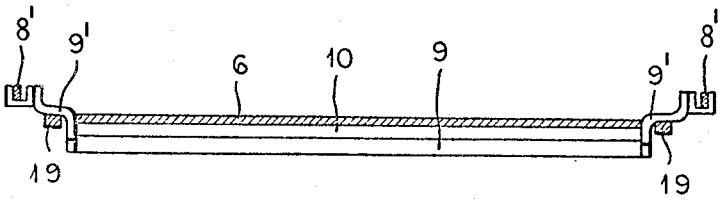
FIG. 4

APPARATUS FOR SPRAYING WORKPIECES AND INTERCEPTING OVERSPRAY

FIELD OF THE INVENTION

My present invention relates to a method of and an apparatus for coloring or otherwise surface-coating a series of workpieces with the aid of one or more nozzles emitting a spray of a hardenable treatment liquid, e.g. a lacquer.

BACKGROUND OF THE INVENTION

In my prior U.S. Pat. No. 4,279,214 I have disclosed and claimed an apparatus of this type wherein the overspray, i.e. the excess of coating material bypassing the workpieces, is intercepted by a moving screen with a substantially vertical front surface facing the spray-emitting nozzle or nozzles. This moving screen, designed as a rotating disk or as an endless band led about a pair of vertically separated deflecting rollers, coacts with a stationary wiper continuously scraping a film of the overspray from that front surface and directing it into an underlying receptacle.

While these prior devices operate generally satisfactorily, the continuous displacement of such an overspray-intercepting screen requires—especially in larger installations—a rather powerful drive motor consuming considerable energy.

OBJECT OF THE INVENTION

The object of my present invention is to provide a simpler, less costly apparatus for the purpose set forth which operates nevertheless in an efficient and dependable manner.

SUMMARY OF THE INVENTION

The improved surface-coating apparatus according to my present invention comprises a stationary overspray-intercepting screen whose front surface is continuously swept by screen-cleaning means including one or more wipers with the aid of drive means vertically displacing the wiper or wipers along the surface.

Advantageously, the drive means may comprise two endless conveyors flanking the screen and supporting respective ends of each wiper. The direction of the conveyor motion should be such that the wiper or wipers descend along the front surface and return to the top of the screen behind the latter; in order to insure proper contact between the screen and each wiper during the scraping operation, the descending runs of the conveyors should closely parallel the front surface of the screen. I also prefer to provide a pair of stationary guide members whose rear edges, paralleling that front surface, are positioned to engage the extremities of a descending wiper for establishing the necessary contact pressure.

Pursuant to another feature of my invention, a sprinkler above the screen continuously directs a solvent for the coating material onto its front surface to maintain the fluidity of the overspray collecting in the wake of the descending wiper.

BRIEF DESCRIPTION OF THE DRAWING

The above and other features of my present invention will now be described in detail with reference to the accompanying drawing in which:

FIG. 2 is a face view of a screen and an associated wiper assembly forming part of the apparatus of FIG. 1;

FIG. 4 is a fragmentary cross-sectional view taken on the line IV—IV of FIG. 2.

SPECIFIC DESCRIPTION

Figure 1:
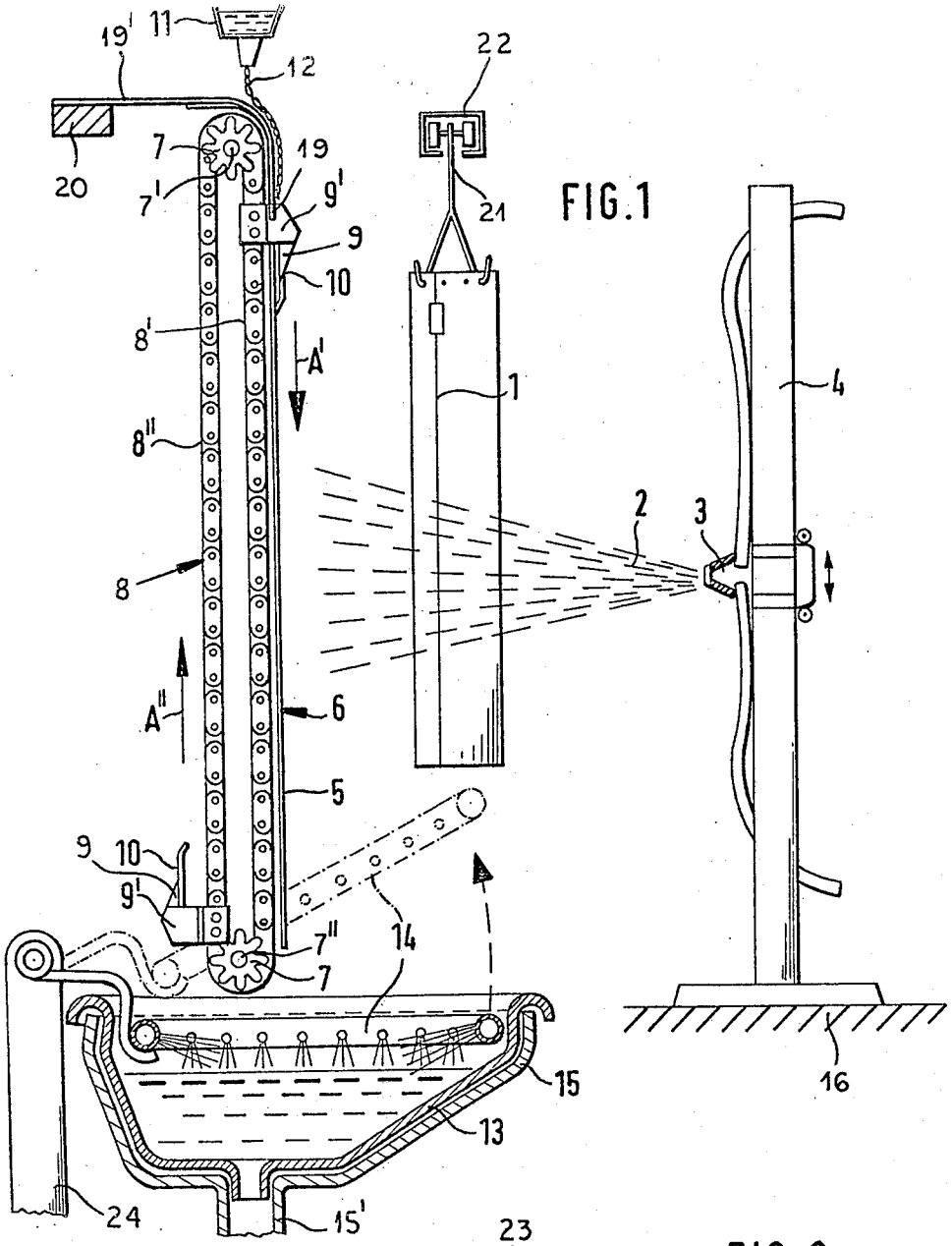
FIG. 1 is a side-elevational view of an apparatus according to my invention.

FIG. 1 shows the interior of a spray booth, generally similar to that disclosed in my above-identified prior patent, wherein a column 4 supports a vertically reciprocable nozzle 3 spraying a lacquer or other coloring agent 2 toward a front surface 5 of a vertical screen 6 which is fixedly disposed behind the path taken by workpieces 1 to be colored, these workpieces being carried on an overhead transporter 21 suspended from a rail 22. Sidewalls (not shown) support horizontal shafts 7' and 7'' of two pairs of sprockets 7 respectively disposed near the upper and lower edges of screen 6 which are spaced from both the ceiling and the floor 16 of the otherwise nonillustrated booth. This spacing enables two wipers 9 to be continuously circulated therearound by two conveyor chains 8 which flank the screen 6 and are looped about these sprockets. The lower shaft 7'' is driven by a motor 17 in a clockwise sense, as viewed in FIG. 1, whereby a more forwardly positioned run 8' of each chain descends while a more rearwardly positioned run 8'' ascends as indicated by arrows A' and A'' in FIG. 1. The wipers 9 have somewhat resilient extremities 9' secured to the chains 8 in a balanced position so that one wiper moves down while the other rises, the descending wiper being held close to the front surface 5 of screen 6 by vertical guide strips 19 which are substantially coplanar with the screen and are connected therewith by stays 18. The strips 19, lying in lateral clearances between screen 6 and conveyor chains 8, have rearward extensions 19' by which they are mounted on a beam 20 of the booth; this beam, therefore, also supports the screen 6, though additional supports (not shown) may be provided at other locations outside the path of motion of the wipers. The strip 19 shown at left in FIG. 2 has been partly broken away in FIG. 1. Each wiper 9 is provided with a resilient scraper lip 10, generally similar to that described in my prior patent, extending horizontally across the entire width of screen 6. The lower edge of the screen lies just above the level of shaft 7'' while its upper edge curves about the shaft 7' to form a deflecting surface for a flow of solvent 12 emitted by an overhead sprinkler 11, this solvent trickling down the screen surface 5 to prevent premature hardening of a film of overspray forming above a descending wiper.

The forward runs 8' of chains 8 are slightly set back from the screen surface 5 and are separated from the screen by clearances accommodating the guide strips 19 whose rear edges bear upon the extremities 9' of a descending wiper, thereby holding its lip 10 in elastic contact with that surface.

Though in principle the use of a single wiper 9 would suffice, the provision of two or more wipers enables a more frequent cleaning of the screen without any acceleration of the conveyor motion.

Figure 3:
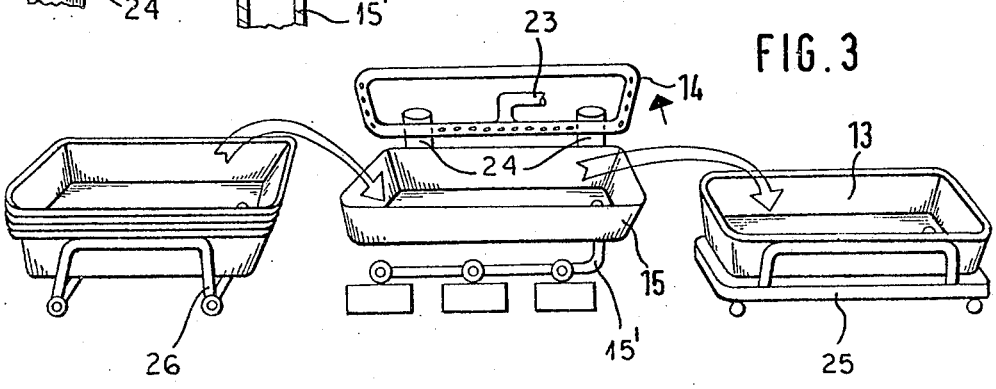
FIG. 3 is a perspective view of an overspray receptacle forming part of the apparatus.

A receptacle 13 below the screen 6 collects the scraped-off overspray and is removably seated in a trough 15 provided with a drain 15'. Additional solvent is admixed with the collected liquid by a perforated tubular frame 14 to which the solvent is fed via a flexible tube 23 and which is pivotally mounted on a pair of posts 24 so as to be upwardly swingable, as shown in phantom lines in FIG. 1, to facilitate a removal of receptacle 13. Drain 15' may return the collected overspray to the supply feeding the nozzle 3; in the case of an impending color change, however, the outlet of the receptacle may be plugged and, with the spray 2 discontinued the completely or partly filled receptacle may be lifted from the trough 15 and deposited on a carriage 25 while another, empty receptacle from a stack on another carriage 26 is put in its place as illustrated in FIG. 3.

I claim:

1. An apparatus for the surface-coating of a series of workpieces with a hardenable liquid, comprising:

a booth;

nozzle means in said booth connected to a source of coating liquid and adapted to discharge same in a spray cone centered on a substantially horizontal axis;

transport means in said booth for carrying a series of generally vertical workpieces along a predetermined path past said nozzle means across said spray cone;

a stationary screen with a substantially vertical front surface facing said nozzle means at a location in said booth behind the path of said workpieces, said front surface being large enough to intercept any excess coating material in said spray cone bypassing the workpieces to be coated;

screen-cleaning means including a substantially horizontal wiper movably extending across said front surface;

drive means coupled with said screen-cleaning means for vertically displacing said wiper along said front surface to scrape said excess coating material therefrom; and a receptacle below said screen for receiving the excess coating material scraped off said front surface.

2. An apparatus as defined in claim 1 wherein said drive means comprises two endless conveyors flanking said screen, said wiper having opposite extremities secured to said conveyors for unidirectional downward entrainment thereby over said front surface and return to the top of said front surface behind said screen.

3. An apparatus as defined in claim 2 wherein said conveyors form loops with descending runs closely parallel to said front surface but separated from said screen by lateral clearances, further comprising stationary upright guide members in said clearances with rear edges paralleling said front surface positioned to engage the extremities of the descending wiper.

4. An apparatus as defined in claim 3 wherein said descending runs are rearwardly offset from said front surface.

5. An apparatus as defined in claim 2, 3 or 4 wherein said wiper is one of at least two substantially identical wipers secured in spaced-apart positions to said conveyors.

6. An apparatus as defined in claim 1, 2, 3 or 4 wherein said wiper is provided with a resilient scraper lip on a leading edge thereof.

7. An apparatus as defined in claim 1, 2, 3 or 4, further comprising sprinkler means above said screen for continuously directing a solvent for said coating material onto said surface.

* * * * *